US005951259A

United States Patent [19]

Gardner et al.

[11] Patent Number: 5,951,259

[45] Date of Patent: Sep. 14, 1999

[54] RECIPROCATING PUMP WITH IMPROVED PRIMER ELEMENT AND METHOD

[75] Inventors: Richard K. Gardner, Montpelier; Leo J. Schlachter, Edgerton, both of Ohio

[73] Assignee: Ingersoll-Rand Company, Woodcliff Lake, N.J.

[21] Appl. No.: 08/876,521

[22] Filed: Jun. 16, 1997

Related U.S. Application Data

[63] Continuation-in-part of application No. 08/638,412, Apr. 26, 1996, abandoned.

[51] Int. Cl.[6] ..... F04B 3/00; F04B 5/00; F04B 7/04

[52] U.S. Cl. ..... 417/254; 417/490; 222/261

[58] Field of Search ..... 417/260, 254, 417/489, 490, 496, 199.1; 222/256, 261

[56] References Cited

U.S. PATENT DOCUMENTS

| | | | |
|---|---|---|---|
| 454,498 | 6/1891 | Robinson | 417/490 |
| 897,498 | 9/1908 | Siegel | 417/490 X |
| 1,770,512 | 7/1930 | De Whalley | 417/490 X |
| 2,022,232 | 11/1935 | Davis | 417/259 |
| 2,122,020 | 6/1938 | Barks | 213/212 |
| 2,136,636 | 11/1938 | Rotter . | |
| 2,294,705 | 9/1942 | Wedeberg . | |
| 2,636,441 | 4/1953 | Woelfer | 417/260 |
| 2,655,287 | 10/1953 | Campbell | 222/123 |
| 2,787,225 | 4/1957 | Rotter | 417/261 |
| 2,925,941 | 2/1960 | Bloxom | 222/254 |
| 3,160,105 | 12/1964 | Sherman et al. | 417/262 |
| 3,312,178 | 4/1967 | Rotter et al. . | |
| 4,875,833 | 10/1989 | Canaud et al. | 417/259 |
| 5,067,882 | 11/1991 | DeVries et al. | 417/511 |

*Primary Examiner*—Ted Kim

*Attorney, Agent, or Firm*—Michael M. Gnibus; Leon Nigohosian, Jr.

[57] ABSTRACT

A reciprocating pump, including: a hollow tube having a first end; a hollow foot valve connected to the tube, the tube and foot valve defining a chamber, said foot valve having a first foot valve end and at least one inlet port formed at the first foot valve end; reciprocating member adapted to be movable in the chamber along a path defined by an axis; drive motor for moving the reciprocating means between a first retracted position and a second extended position; and a primer element connected to the reciprocating means, said primer element having a first dimension and a second dimension, said second dimension being equal to at least half of the first dimension.

10 Claims, 5 Drawing Sheets

RECIPROCATING PUMP WITH IMPROVED PRIMER ELEMENT AND METHOD

This application is a continuation-in-part of application Ser. No. 08/638,412, filed Apr. 26, 1996, now abandoned.

FIELD OF THE INVENTION

This invention generally relates to a reciprocating pump and method for pumping a high viscosity material from a container, and more particularly to an improved reciprocating pump and method where the pump includes an improved primer element that has a first dimension, and a second dimension that is equal to at least one-half of the first dimension.

BACKGROUND OF THE INVENTION

Reciprocating pumps are utilized to transfer a high viscosity material typically grease or the like from a container such as a drum or barrel to an object of interest which may be a car chassis for example. Such pumps are typically oriented vertically during operation and include a drive motor located outside the container on the container lid, and a reciprocating member operatively connected to the motor to be driven by the motor in a pump chamber. The reciprocating member is placed inside the container and is immersed in the material to be transferred. Because the material transferred by reciprocating pumps is usually of a relatively high viscosity transferral of such material is difficult.

In order to more easily transfer high viscosity materials, conventional reciprocating pumps include a means for pulling or "shoveling" the material from the storage container into the pump. Such means is comprised of a primer element located, proximate the bottom of the drum. The primer element is attached to the reciprocating member and is located adjacent the pump inlet.

During operation of a conventional reciprocating pump, the primer element is moved with the reciprocating member along a linear axis. The primer element is displaced along the linear axis in a first direction, toward the bottom of the material to be transferred, and is then displaced in a second direction, opposite the first direction, toward the surface of the material to be transferred. As the primer element is displaced in the second direction, it acts like a shovel and pulls the medium into the pump.

There are problems with conventional primer elements. Conventional primer elements have a thickness that is significantly less than the diameter or longitudinal dimension of the primer element. Known primer elements resemble a conventional washer that may be used in combination with a bolt. Such known primer elements do not provide a sufficient seal with the pump chamber walls when the reciprocating member is moved in the second direction, permitting material to leak past the primer out of the pump and return to the container. Moreover, the primer does not pull a significant amount of material into the pump. The volume of material transferred by conventional reciprocating pumps is limited by conventional primer elements.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a reciprocating pump including a hollow tube; a hollow foot valve connected to the tube, the tube and foot valve defining a chamber, said foot valve having a first foot valve end and at least one inlet port formed at the first foot valve end; a reciprocating member adapted to be movable in the chamber along a path defined by an axis; drive motor for moving the reciprocating member between a first retracted position and a second extended position; and a primer element connected to the reciprocating means, said primer element having a first dimension and a second dimension, said second dimension being equal to at least half of the first dimension.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE PREFERRED EMBODIMENT

Figure 1:
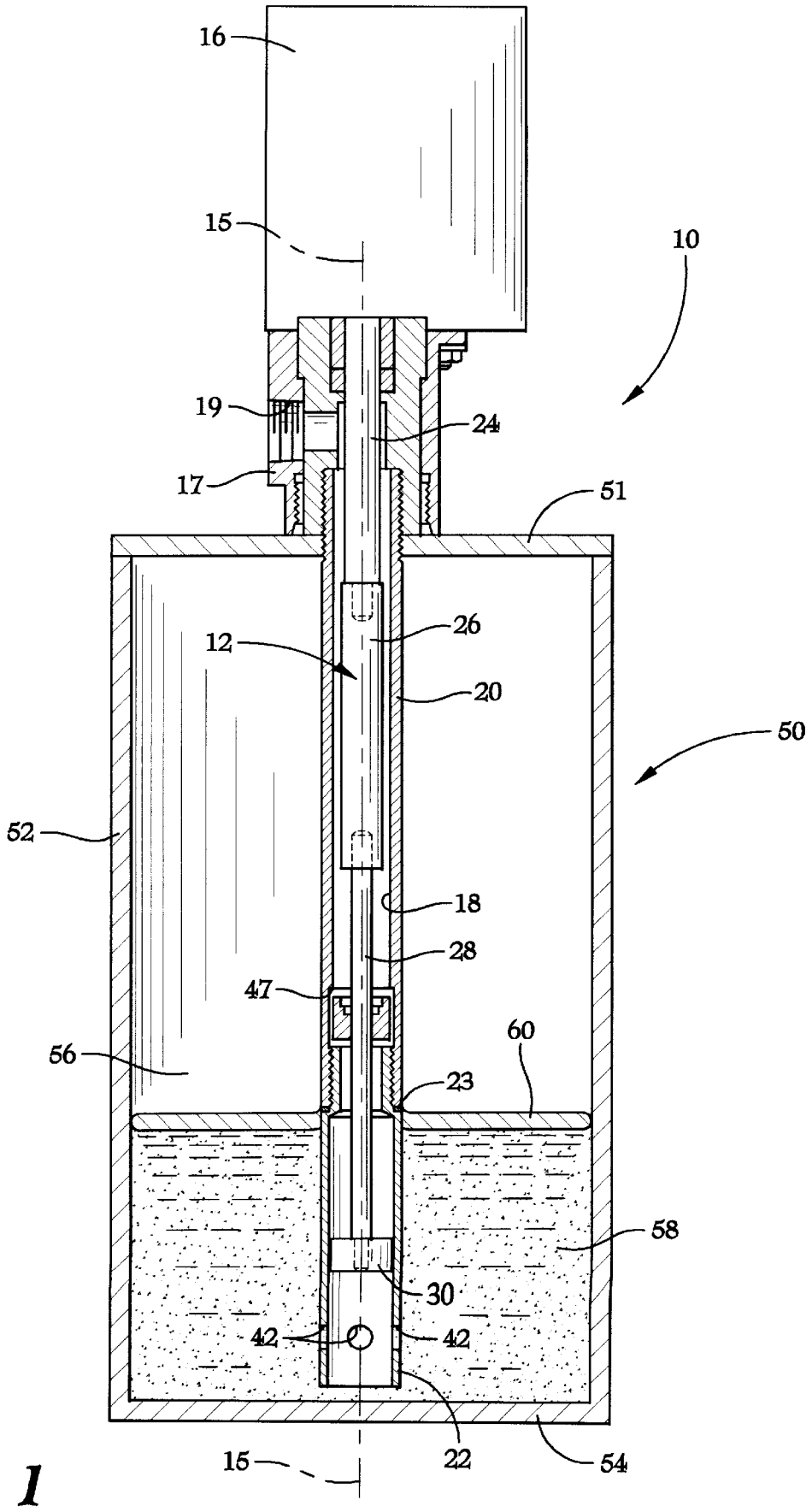
FIG. 1 is a longitudinal sectional view of the reciprocating pump of the present invention showing the primer element in a first, retracted position.

Referring now to the drawings, wherein similar reference characters designate corresponding parts throughout the several views, FIG. 1 shows a reciprocating pump generally indicated at 10. FIGS. 1–4 show a first embodiment of the invention. The pump includes reciprocating means 12 that is movable along axis 15 by motor 16. The reciprocating means is movable in pump chamber 18 that is defined by tubular member 20 and foot valve 22. The reciprocating means 12 is movable between a first position retracted position shown in FIG. 1 and a second extended position shown in FIG. 2. The tube and foot valve 22 are cylindrical however the members 20 and 22 may in fact be any suitable shape.

Figure 2:
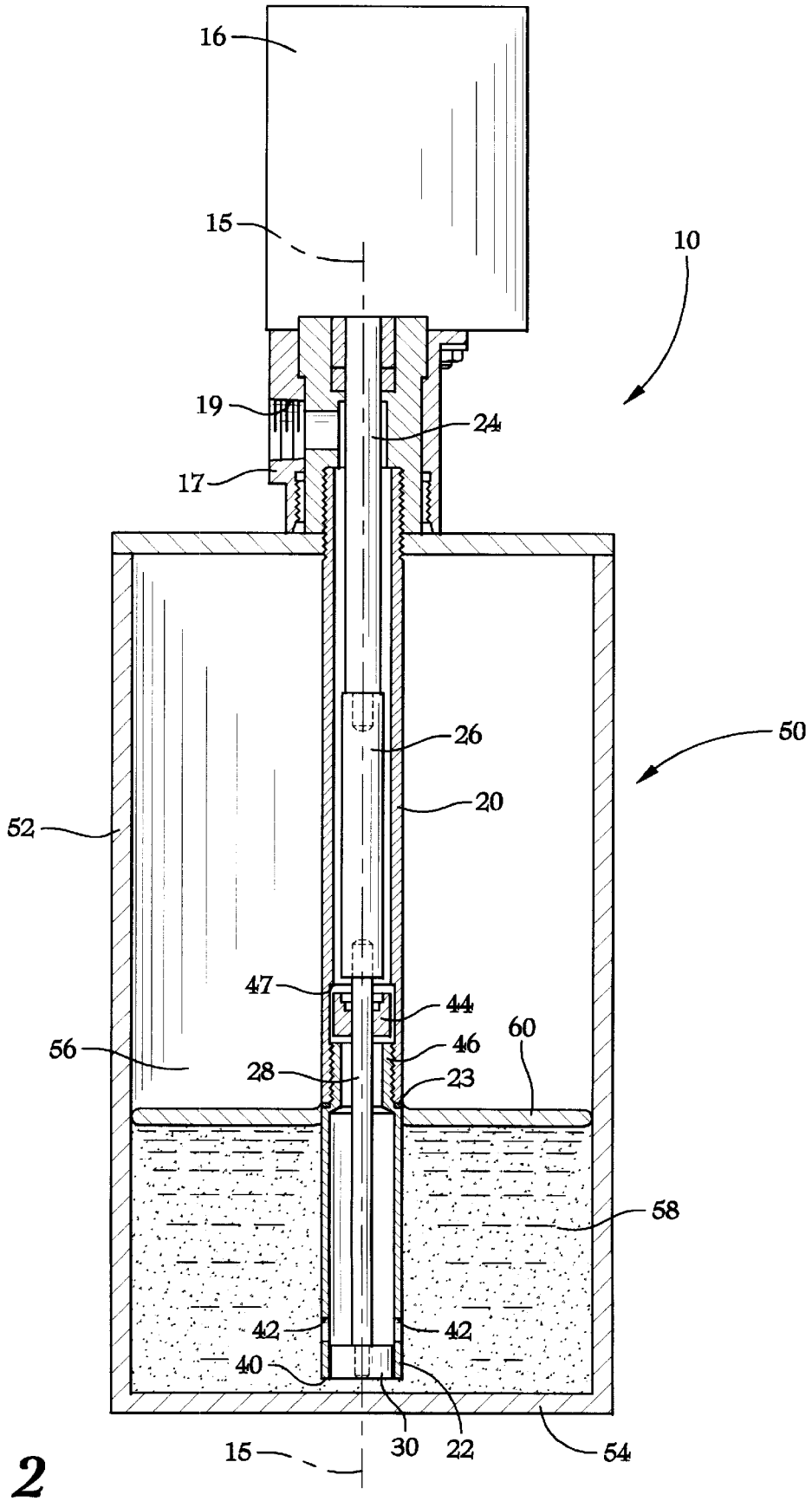
FIG. 2 is the longitudinal sectional view of FIG. 1 showing the primer element in a second, extended position.

Motor 16 is shown schematically in FIGS. 1 and 2 and may be any motor suitable to move reciprocating member 12 in the manner required. The motor may be a pneumatically driven piston motor and may further be a single-acting or double-acting piston motor well known to one skilled in the art.

The motor 16 is adapted to be supported by pump housing 17 which includes a material discharge port 19. The pump housing in turn is adapted to be supported by the lid 51 of container 50. The container cylindrical sidewall 52 and base 54 define a material storage chamber 56 where material 58 such as grease is stored before it is transferred by pump 10 to an object of interest. The material may be grease 58 as shown in FIGS. 1 and 2 or may be any other highly viscous material such as paint or oil.

The tube 20 and foot valve 22 are located in the material storage chamber 56 with foot valve 22 located near base 54. The tubular member 20 and foot valve 22 are immersed in the material 58 when the container is full. A relatively heavy follower plate 60 is seated on the surface of the material 58 and is adapted to be slidable along the length of the tube and foot valve toward container base 54, as the material 58 is transferred out of the container by the pump 10. The follower plate is displaced toward base 54 by gravity and in this way, the material remaining in the container is compacted in the chamber 56 between base 54 and the follower plate. The clearance between the outer periphery of the follower plate and container sidewall 52 is small so that as the follower plate moves toward the base 54 of the container 50, any material on the sidewall 52 is scraped therefrom by the follower plate.

Hollow, elongate tube 20 has a first end near discharge port 19 that is threadably connected to pump housing 17 and a second end located in material storage chamber 56. An interior threaded portion is provided along the interior of the second tube end. The threaded portion is adapted to mesh with an externally threaded portion of hollow foot valve 22 in the manner shown generally in FIGS. 1 and 2. The threaded connection between the tube and foot valve is sealed by a conventional sealing member 23 which may be an o-ring seal.

Pump chamber 18 is defined by the hollow interiors of tube 20 and foot valve 22. As shown in FIGS. 1 and 2, the portion of the chamber defined by the foot valve is relatively narrow at the threaded end of the valve and is relatively wide along the remainder of the length of the foot valve.

The foot valve includes an inlet end 40, seat 46, and a plurality of inlet ports 42 spaced equidistantly circumferentially along the circumference of foot valve 22 at the inlet end. See FIG. 1. In the preferred embodiment, there are four inlet openings, each opening spaced from each adjacent opening by ninety degrees. It should be understood that any suitable number of inlet openings may be provided. Material 58 flows into the pump chamber 18 through the inlet ports 42.

A conventional check valve 44 is adapted to move into and out of engagement with seat 46 to thereby intermittently permit material to flow through chamber 18, toward discharge port 19, in the manner that will be described in detail hereinbelow.

Shoulder 47 limits the distance check valve 44 may be displaced from seat 46.

Reciprocating means indicated generally as 12 is comprised of three discrete reciprocating members 24, 26, and 28. The members are adapted to move in chamber 18 during operation of pump 10. For purposes of clarity, hereinafter the first reciprocating member 24 may also be referred to as a pump rod, the second reciprocating member 26 may be referred to as a connection member and the third reciprocating member 28 may also be referred to as a primer rod. Pump rod 24 and primer rod 28 are joined by the connection member 26. The members may be joined by any conventional means including a threadable connection or a bolt or other conventional means. In the preferred embodiment, member 26 is threadably joined to the first and third members 24 and 26. The first reciprocating member is connected to the motor 16 to be movable directly by the motor 16.

As shown in FIGS. 1 and 2, continuous fluid flow conduit is fined between the inner wall of the chamber and the outer periphery of the first, second, and third reciprocating members. A portion of the length of the conduit is defined by the check valve seated in the chamber. The conduit flow connects the outlet 19 and inlet openings 42. The fluid drawn into the pump is flowed through the continuous conduit.

Primer element 30 is attached to the lower end of third connecting member 28. The primer element is connected to the third member threadably, but may be connected to the primer rod 28 by any conventional means. The primer element is cylindrical and has first dimension 32 and second dimension 34. The second dimension must be equal to at least half of the first dimension. In the preferred embodiment, the primer element is cylindrical and the first dimension 32 is equal to the outer diameter of the primer element and the second dimension 34 is the height or thickness of the element. The second dimension 34 may be greater than half the first dimension 32.

Figure 3:
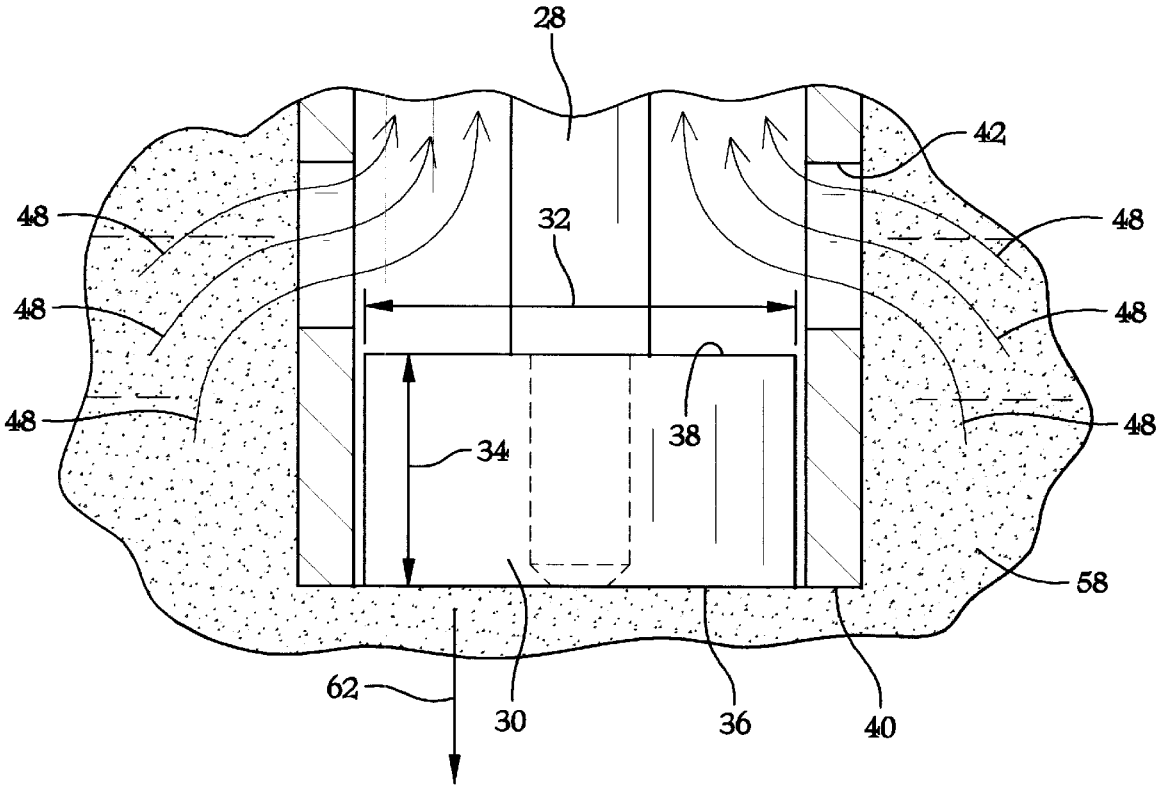
FIG. 3 is an enlarged view of a portion of the sectional view of FIG. 2.
Figure 4:
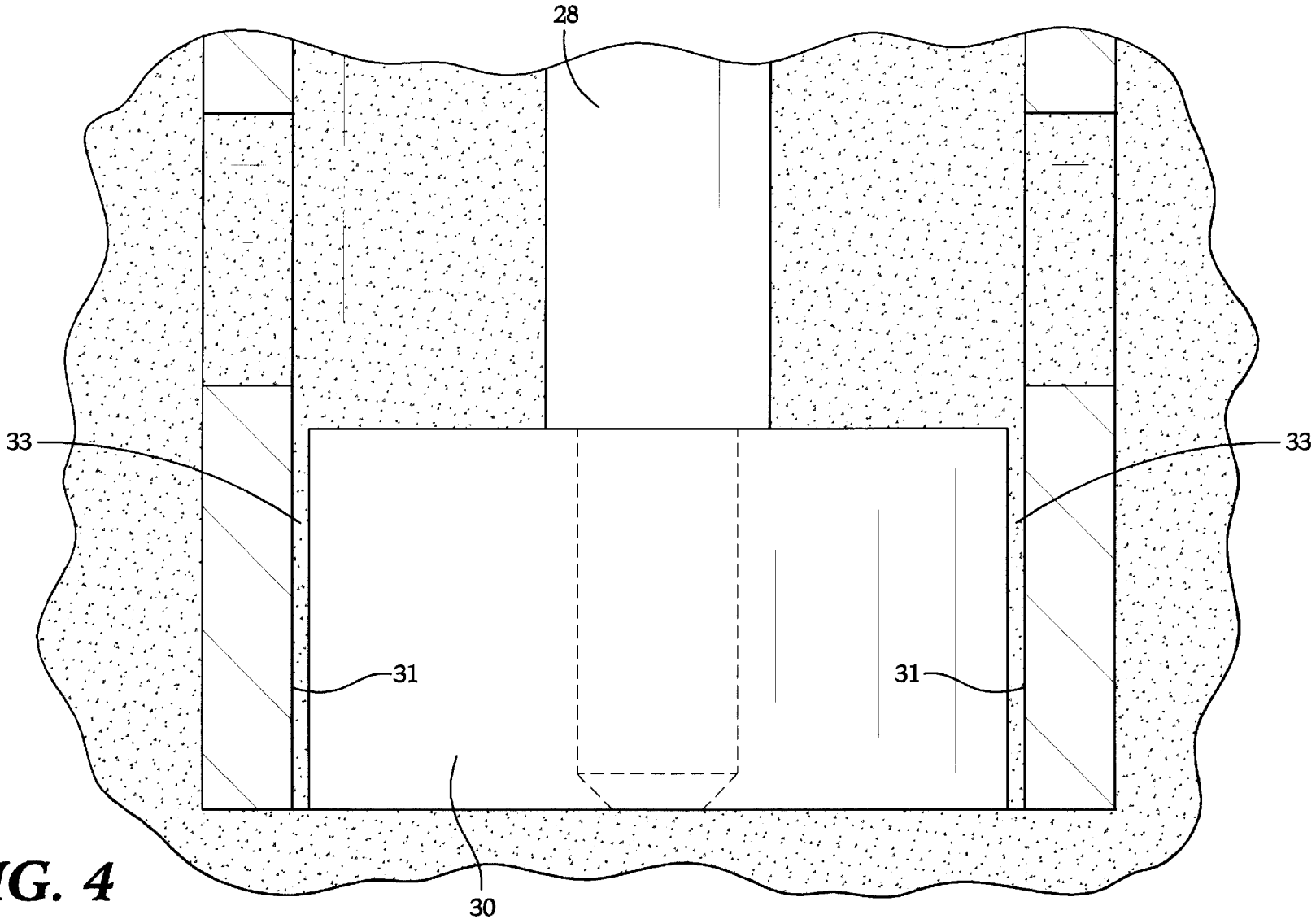
FIG. 4 is an enlarged view of the primer element of FIG. 3 showing the seal formed in the seal chamber.

A seal chamber 31 is formed between the outer periphery of the element and the inner wall of the inlet end 40. The seal chamber 31 is annular and extends completely around the primer element 30. The seal chamber cross-section is rectangular as shown in FIG. 3, and is defined laterally by the clearance between the top and bottom outer peripheral edges of the primer element and the immediately adjacent section of the inlet end, and longitudinally by the height dimension of the primer element and the immediately adjacent section of the inlet end. Thus, the longitudinal or height dimension of the chamber is equal to at least half the diameter of the primer element.

During pump operation, fluid 58 collects in and fills the chamber as the primer element is retracted upwards, and as a result, a seal 33 is formed between the inlet end and element 30. See FIG. 4. By making the clearance between the primer element and inlet end small, and the primer element height at least half the diameter of the element 30, the required seal is produced.

By providing a primer element 30 with a height dimension 34 is equal to at least one-half of the outer diameter dimension 32 more material 58 will be transferred through the pump 10 than would be transferred using a conventional primer element. The seal that is formed between the primer element and inlet end prevents fluid 58 from leaking past the primer element as the primer element is moved towards the retracted position, thereby maximizing the volume of fluid transferred by the pump. A conventional primer element does not have a height that is at least one half the diameter of the element and a seal chamber defined between the prime mover and inlet end with a rectangular cross-section and a height equal to the height of the primer element.

The bottom of inlet ports 42 are spaced from the inlet end of the foot valve by a distance approximately equal to the second dimension 34. In this way, when the primer element is in the extended position, the element will not cover any portion of the ports and will not impede the flow of material into the pump chamber 18. The outer wall of the primer element and the wall of pump chamber wall 20 are separated by a clearance of 0.015 of an inch. See FIG. 3. The small clearance of 0.015 of an inch between the primer element peripheral wall and pump chamber wall permits a sufficient seal to be created during pump operation without backfiring.

Tests performed in Bryan, Ohio proved that more material is transferred through pump 10 using a primer element 30 where the second dimension 34 is at least half of first dimension 32. The tests were conducted in March of 1996 using pumps that were otherwise identical except that one pump included primer element 30 having a dimension 34 equal to 0.625 of an inch and the other pump included a conventional primer element having a dimension of 0.125 of an inch. The diameter 32 of each primer element was 0.750 of an inch. In one pump, dimension 34 was 0.80 of dimension 32 and in the other pump, dimension 34 was 0.17 of dimension 32. The material pumped was conventional No. 2 grease and the motor was a pneumatically actuated double-acting piston motor operating at 100 psi. The pump with the improved primer element 30 transferred grease out of the container at a rate of 2.84 lbs/min and the pump with the conventional primer element transferred grease at a rate of 1.76 lbs/min.

Operation of pump 10 will now be described. Pump motor 16 moves the reciprocating means 12 and primer element 30 in pump chamber 18 between the retracted position shown in FIG. 1 and the extended position shown in FIG. 2. When the reciprocating means and element are displaced from the retracted position to the extended position, material 58 adjacent face 36 is forced out of the foot valve inlet end 40 in the direction shown generally by arrow 62 and is mixed with the volume of material 58 stored in chamber 56. As the primer element 30 is moved past inlet ports 42, to the extended position, material 58 enters chamber 18 through ports 42 in the direction indicated by arrows 48. See FIG. 3. The check valve 44 is seated against seat 46 as the primer element 30 and reciprocating means are moved to the extended position by the motor 16.

When at the extended position, element 30 is located between ports 42 and inlet end 40. Motor 16 then moves the reciprocating means 12 and element 30 along axis 15 to the retracted position. As the primer element is moved toward the retracted position, the primer acts like a shovel and forces the material 58 that was previously flowed into the chamber through the inlet ports, toward the discharge port 19. As the primer element is moved to the retracted position, the fluid 58 collects in seal chamber 31 and forms a seal between the primer element and inlet end that prevents fluid from leaking past the primer element. The material 58 adjacent face 38 is pumped toward discharge 19. The upward displacement of the material forces the check valve 44 off the seat 46 and permits the material to flow past the valve.

Figure 5:
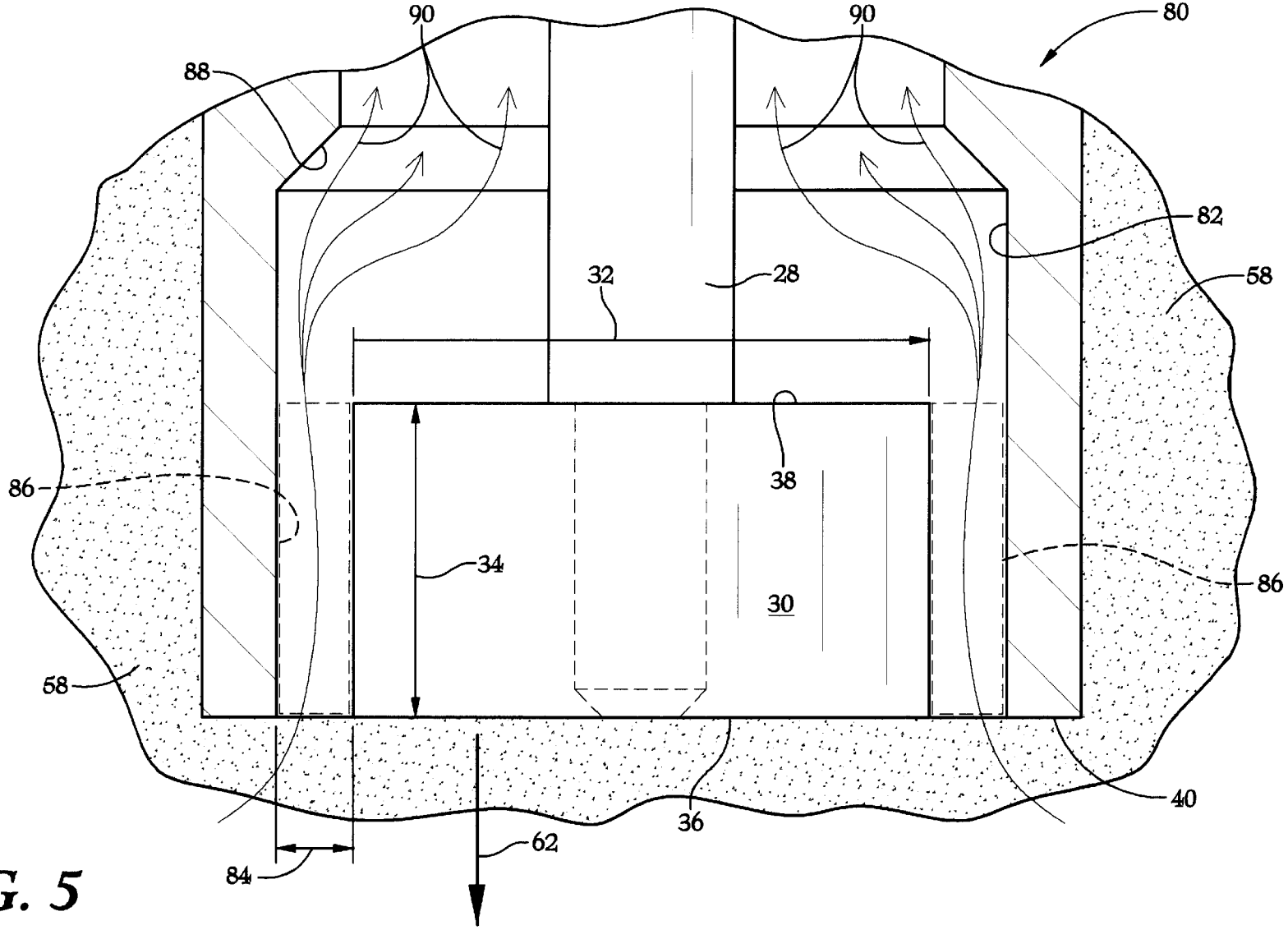
FIG. 5 is an enlarged view like the enlarged view of FIG. 3, showing an alternate embodiment of the invention.

The reciprocating motion is repeated rapidly to transfer material from the container 50. The small clearance between the primer element and chamber wall produces a better seal therebetween as the element 30 is moved to the retracted position and thereby prevents material from leaking out of the chamber in direction 62. Also, the primer element having dimension 34 equal to at least one-half of dimension 32 permits a greater mass of material 58 to be transferred from the material storage chamber 56. FIG. 5 shows an alternate embodiment of the invention. The alternate embodiment 80 is identical to the first embodiment shown in FIGS. 1–4 except that radially oriented inlet ports 42 have been replaced by a single wide axial inlet port 82. The inlet port 82 narrows away from end 40 at shoulder 88.

An annular seal chamber 86 like chamber 31 has a rectangular cross-section that is defined laterally between the wall of the inlet port 82 and the top and bottom peripheral edges of the primer element 30. The lateral or radial dimension of the seal chamber is referred to at 84. The height or longitudinal extent of the seal chamber is defined by the height dimension 34 of primer button 30 and adjacent segment of inlet 40.

During operation of pump 80, upon beginning to move primer element 30 into the fully extended position shown in FIG. 5, material 58 which was previously present below the primer element when in the retracted position is pushed out the open end of the foot valve. The back pressure created by the material 58 within container 50 and additionally by weigth of the follower plate 60, if present, causes the material displaced by primer element 30 to be forced into axial inlet port 82 of the foot valve. At this state, the seal chamber is filled with fluid 58 and thereby forms a seal between the primer element 30 and inlet end 40 that prevents fluid transferred into chamber 18 from leaking past the primer element 30 and outward from the inlet 82 in the direction of arrow 62.

During continued movement of primer element 30 into the fully extended position shown in FIG. 5, the fluid 58 is forced around and past primer element 30, through seal chamber 86 in the direction of arrows 90, and into chamber 18. Upon moving the primer element again upward into the retracted position above shoulder 88, the volume of fluid which has collected in the seal chamber forms an annular seal that prevents the volume of material 58 which has collected above primer element 30 from leaking past the primer element 30 into container 50. The seal chamber dimension 84 must be relatively small and the height dimension must equal the primer element dimension 34 which is at least half the dimension 32, in order for the required seal to be formed.

An effective seal is formed when a highly viscous fluid such as No. 2 grease is transferred by the pump.

Radially oriented apertures (not shown) like inlet ports 42 or a notch may be provided adjacent end 40. In the event that the inlet end is placed near or on the bottom of a fluid storage container and the fluid can not be flowed through clearance 84, the fluid may enter the inlet end through the apertures.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A reciprocating pump, for transferring a pumped fluid, the reciprocating pump comprising:

a housing which defines a pumped fluid outlet; a hollow tube having a first end; a hollow foot valve connected to the hollow tube at the first tube end, the hollow tube and foot valve defining a chamber having a longitudinal axis, said foot valve having a first foot valve open end having an opening which lies in a plane transverse to said longitudinal axis and at least one inlet port formed at the first foot valve end; a check valve seated in the chamber; reciprocating means movable in the chamber along a path defined along said longitudinal axis; a continuous pumped fluid transfer channel defined between the outer periphery of the reciprocating means, the check valve, and the chamber, said channel flow connecting the pumped fluid outlet and the at least one inlet; drive means supported by said housing, said drive means moving the reciprocating means between a first retracted position whereby a pumped fluid is transferred through the channel, and is discharged through the pump outlet, and a second extended position whereby the pumped fluid is flowed into the chamber through the at least one inlet port; and a unitary cylindrical primer element connected to the reciprocating means capable of movement into said opening of said foot valve and preventing fluid flow through said reciprocating means, said primer element having a diameter and a height, said height being equal to at least half of the diameter said primer element and first foot valve end defining a seal chamber therebetween.

2. The reciprocating pump as claimed in claim 1 wherein the reciprocating means includes a first member operatively connected to the drive means, a primer rod and a connection member connecting the primer rod and first member, said primer element threadably connected to the primer rod.

3. The reciprocating pump as claimed in claim 1 wherein the foot valve has an inlet end and the at least one inlet port is located a distance away from the inlet end, said distance being at least equal to the height of the primer element.

4. The reciprocating pump as claimed in claim 1 wherein the seal chamber is defined laterally by a relatively small dimension and the longitudinal dimension is equal to the height of the primer element.

5. The reciprocating element as claimed in claim 4 wherein the seal chamber is annular and extends completely around the primer element.

6. The reciprocating pump as claimed in claim 4 wherein the pump seal chamber has a rectangular cross-section.

7. The reciprocating pump as claimed in claim 1 wherein the seal chamber has a lateral dimension defined between an outer diameter of said primer element and an inner diameter of said foot valve which remains constant along the circumference of the seal chamber.

8. The reciprocating pump as claimed in claim 1 wherein the fluid pumped is No. 2 grease.

9. The reciprocating pump as claimed in claim 1 wherein said foot valve has an inner diameter which is greater at said opening than in said chamber of the foot valve and said at least one inlet port is an axial inlet port formed between said inner diameter of said opening and an outer diameter of said primer element when said reciprocating leans is in said second extended position.

10. In a reciprocating pump comprising a hollow tube having a first end; a hollow foot valve connected to the hollow tube at the first tuba end, the hollow tube and foot valve defining a chamber having a longitudinal axis, said foot valve having a first foot valve open end having an opening which lies in a plane transverse to said longitudinal axis and at least one inlet port formed at the first foot valve end; a check valve seated in the chamber; reciprocating means movable in the chamber along a path defined along said longitudinal axis; a continuous pumped fluid transfer channel defined between the outer periphery of the reciprocating means, the check valve, and the chamber, said channel flow connecting the pumped fluid outlet and the at least one inlet; drive means moving the reciprocating means between a first retracted position whereby a pumped fluid is transferred through the channel, and is discharged through the pump outlet, and a second extended position whereby the pumped fluid is flowed into the chamber through the at least one inlet port; a unitary cylindrical primer element connected to the reciprocating means capable of movement into said opening of said foot valve and preventing fluid flow through said reciprocating means, said primer element having a diameter and a height, said height being equal to at least half of the diameter; and an annular seal chamber formed between the primer element and the foot valve, said seal chamber having a rectangular cross-section; the method for pumping a material comprising the following steps: moving the reciprocating means and primer element to the extended position; flowing material through the at least one inlet port; moving the reciprocating means and primer element to the retracted position; forming in a seal chamber between the primer element and first foot valve end; and pulling material flowed through the at least one inlet port into the pump.

* * * * *